US011697522B2

(12) United States Patent
Steele et al.

(10) Patent No.: US 11,697,522 B2
(45) Date of Patent: Jul. 11, 2023

(54) LOCKING SLIDING BOX CLOSURE

(71) Applicant: FELLOWES INC., Itasca, IL (US)

(72) Inventors: Anton Steele, Naperville, IL (US); Isaac Hulbert, Downers Grove, IL (US); Mitch Rydholm, Batavia, IL (US)

(73) Assignee: Fellowes, Inc, Itasca, IL (US)

( * ) Notice: Subject to any disclaimer, the term of this patent is extended or adjusted under 35 U.S.C. 154(b) by 27 days.

(21) Appl. No.: 17/332,617

(22) Filed: May 27, 2021

(65) Prior Publication Data

US 2021/0371154 A1 Dec. 2, 2021

Related U.S. Application Data

(60) Provisional application No. 63/030,772, filed on May 27, 2020.

(51) Int. Cl.
*B65D 5/10* (2006.01)
*B65D 85/18* (2006.01)
*B31B 100/00* (2017.01)

(52) U.S. Cl.
CPC ..... *B65D 5/106* (2013.01); *B65D 85/185* (2013.01); *B31B 2100/0024* (2017.08)

(58) Field of Classification Search
CPC ..... B65D 5/10–106; B65D 85/185
USPC ..... 229/155–158; 206/289–290
See application file for complete search history.

(56) References Cited

U.S. PATENT DOCUMENTS 3,294,221 A * 12/1966 Notko ..... B65D 85/185 229/122
4,111,300 A * 9/1978 Partain ..... B65D 85/185 206/290
4,279,377 A * 7/1981 Peeples ..... B65D 5/10 229/185
4,884,741 A * 12/1989 Nederveld ..... B65D 5/10 229/185
5,046,662 A * 9/1991 Cowles ..... B65D 5/10 229/185
5,104,035 A * 4/1992 Rosenbaum, II ..... B65D 5/10 229/157
5,305,950 A * 4/1994 Oppenheim ..... B65D 5/10 229/185
2006/0163333 A1* 7/2006 Kornacki ..... B65D 5/4295 229/157
2022/0194689 A1* 6/2022 Chen ..... B31B 50/81

FOREIGN PATENT DOCUMENTS

KR 20130059575 A * 6/2013
WO WO-2011148400 A1 * 12/2011 ..... B65D 5/106

* cited by examiner

*Primary Examiner* — Nathan J Newhouse
*Assistant Examiner* — Phillip D Schmidt
(74) *Attorney, Agent, or Firm* — Wood, Phillips, Katz, Clark & Mortimer

(57) ABSTRACT

The invention disclosed herein is an improved panel arrangement for closing a box. The invention includes two sliding panels and two slotted panels, each slotted panel having a first slot and a second slot for receiving a terminal edge of a sliding panel. In some embodiments of the invention, a flap or flaps are present about a perimeter edge of the slots to allow better access to the slots by the terminal edges of the sliding panels.

16 Claims, 9 Drawing Sheets

LOCKING SLIDING BOX CLOSURE

BACKGROUND OF THE INVENTION

Field of the Invention

The present invention relates to boxes, and more specifically to a locking and sliding arrangement to close and secure the top, bottom, or end panels of boxes.

Background Art

Boxes are well known and ubiquitous articles commonly used to store and transport goods. Boxes typically are rectangular cuboids and have six faces when closed. Those skilled in the art will recognize boxes may have other configurations and the invention disclosed herein may be applicable to such other configurations.

Typically a rectangular cuboid box includes four side faces formed by four side panels that define an inner space in which goods may be placed and contained. The four side panels include two opposing pairs of side panels. In some embodiments, two opposing end faces are formed by end panels that are extensions of the side panels of the box, however other configurations are possible. Typically one end of the box is closed and forms the bottom of the box, and the other or top end is configured to be selectively opened and closed so that contents may be placed into and secured into the box. One will recognize that one or both end faces of the box may be configured to selectively open and close.

The end panels may be formed, arranged and manipulated in many ways to selectively open and close the ends of the box. In some boxes the top is created by a single end panel that is formed by the extension of one of the side panels. The end or top panel is hingedly connected to a side panel by a line of weakness such as a fold line, and is large enough to span the opening and extend to or beyond the opposing side panel. Such top panels often have a tab portion that may be folded to fit inside the box and rest against the inside surface of the opposing panel.

In another example, the top or lid may be formed by the extensions of two opposing side panels which extend at least halfway across the top of the box. The extensions or lid panels may meet in the middle of the opening, or they may extend slightly past the middle. One skilled in the art will recognize that the length of each of the side extensions may be altered such that the combination of both side extensions equals or exceeds the distance across the opening of the box. In any of the examples discussed herein, the box may have complementary structures, such as slots and tabs to join or secure the lid panels to one another, or to the side panels of the box.

In another example, all four sides of the box include extensions or lid panels. The lid panels from each of the opposing sides may extend at least halfway across the opening. The lid panels are typically folded down in opposing pairs, with one pair of opposing lid panels being folded down first, followed by the second pair of opposing lid panels, which then lie upon the first pair of opposing lid panels. This creates a double thickness top. The second or outer pair of panels is then typically closed with tape or staples. Other mechanisms may also be used to close the box or join the panels.

Of particular interest to the present invention are wardrobe boxes or containers that are used to ship clothing or apparel that is on clothes hangers. These types of boxes include a bar or other structure across the top opening. The clothes hangers may then be hung on the bar to allow the clothes or apparel to be suspended within the box. The bar is typically placed across the opening of the box by clipping the bar ends over the edge of opposing sides of the box. The bar ends include a clip structure that includes a channel to accept and capture an edge of a side panel of the box. To allow the bar to be clipped or positioned on or over the edge of sides of the box, the lid panel connected to the side of the box includes a cutout or other opening to allow the bar ends access to the edge of the box side.

Further, it is desirous for the lids of the wardrobe box to close tightly and leave minimum openings so that dirt or other contaminants do not enter the box during shipment or storage. In past boxes, tape and other fasteners have been used to close the box, while this leaves minimum openings, the additional components add to the complexity of assembly. The additional components such as adhesive tape and staples also limit the reusability of the box. The features of the present invention allow the box to be easily assembled and reuses multiple times.

SUMMARY OF THE INVENTION

The invention disclosed herein is an improved closure for a box, most particularly a wardrobe box. While a wardrobe box is shown in the figures, the structures described herein are applicable to any box.

The invention disclosed is a box including an interlocking top or lid arrangement allowing the panels that close an opening of the box to be easily interlocked with one another to secure the top.

The box includes four lid panels, each panel formed as an extension of a side panel. A lid panel is connected to a side panel by at least one line of weakness or fold line and may be considered an extension of the side panel to which it is connected. In embodiments where there are four side panels including two pairs of opposing side panels, the lid panels also oppose each other and may be considered as opposing pairs of panels.

The panels of each opposing pair of panels generally reach or extend to each other to cover the opening of the box. In some embodiments, the panels may overlap, or they may not reach each other.

A first pair of opposing lid panels may be placed or folded over the box opening before the second pair of opposing lid panels. The first pair of lid panels may be considered the inner panels, and the second pair may be considered the outer panels. Although the panels may be considered as inner or outer panels, portions of the panels may overlie each other, resulting in a portion of an inner panel being exposed to the outside of the box, and portions of an outer panel being under an inner panel.

In some embodiments, the pairs of lid panels may be considered as the sliding panels, and the slotted panels. In such embodiments, the slotted panels are folded to extend over the opening of the box. The terminal ends of the panels are preferably close to each other, overlapping, or touching to prevent the entry of dirt and other debris. The sliding panels are folded after the slotted panels and include an intermediate line of weakness or fold line between the terminal end and the fold line connecting the sliding panel with a side panel. A terminal end of a sliding panel is inserted into slots in each of the slotted panels to secure a portion of the sliding panel under a portion of each of the slotted panels.

In some embodiments, to further secure the sliding panels and prevent them from sliding out of the slots of the slotted panels, the sliding panels may include tab slots to accept tabs from the slotted panels. The tabs may be on the portions of the slotted panels that lay above the sliding panels, and are thus exposed to the outside of the box and available to the manipulated by a user located outside of the box.

In some embodiments, the terminal end of the slotted panels are narrower than the attached end. This may also be described as having a contoured terminal end. The contour may extend to the lateral side edges of a sliding panel. Such contour permits the terminal end of the sliding panel to be more easily placed into the slots of the slotted panels, since the side edges of a sliding panel are nearer to the fold line end of a slot.

The contour edges of the terminal end of the sliding panels may also fit into contoured portions of the bar assembly that may be placed across the opening of a box. The contour portions of the bar assembly may be located on the top surface of the bar assembly near the area where the bar joins, merges, or is coupled to the clip portion of the bar assembly. The contour portions of the bar assembly may include depressions to accommodate the contour portion of the terminal and lateral portions of the sliding top panels.

The slotted panels may include two slots or insertion slots per panel. This allows each slotted panel to receive, capture, or otherwise interact with each of the sliding panels. The slots may be of any shape. The slots on any one panel are laterally offset from each other. The slots may be formed by die cutting or any other means used to cut box materials. The cuts that form the slots may be arcuate, contoured, or linear, and multiple cuts may be joined to form one slot. The slots may be spaced apart from each other to increase the integrity, strength, and durability of the box. It is preferred that linear portions of different slots on a single slotted panel do not align with one another to improve the integrity, strength, and durability of the box.

The slots may include rounded corners where edges terminate or meet. The rounded corners improve the ability of the terminal ends of the slotted panels to be inserted into the slots. The rounded corners also provide an effective extension of the length of the slot. The rounded corners also provide a transition area that transitions the cut of the slot from being at an first angle to the terminal edge of the sliding panel to one that is at a second angle to the terminal edge of the sliding panel.

The portions of the panels adjacent to the cuts that form the slots may include a flap. The flap may be depressed below the surface of the panel, or extended above the surface of the panel, creating a larger opening or a flexible opening to allow easier entry of the terminal end of the sliding panel. The flaps may be formed by cuts that extend away from the cuts that form the slots. The flap cuts may be contoured or linear lines. The flap cuts may be joined by a line of weakness to define a line along which the flap may hinge, bend, or flex above or below the surface of the panel.

The slotted panels may also include locking tabs that may be inserted into locking slots in the sliding panels. The locking tabs are formed by cuts or perforations and include rounded or contoured corners and transitions at the terminal ends or base of the cuts or perforations. The locking tab terminal edge or end may be tapered or contoured to more easily slide into the locking slot.

In one form, the invention is directed to a box including four side panels and four top panels. A first side panel is hingeably connected to a first sliding top panel. A second side panel is hingeably connected to a first slotted top panel. A third side panel is hingeably connected to a second sliding top panel. A fourth side panel is hingeably connected to a second slotted top panel. The first sliding top panel has a first sliding top panel terminal edge. The second sliding top panel has a second sliding top panel terminal edge. The first sliding top panel includes a first sliding top panel fold line located between a connection to the first side panel and the first sliding top panel terminal edge. The second sliding top panel includes a second sliding top panel fold line located between a connection to the third side panel and the second sliding top panel terminal edge. The first slotted top panel includes a first slot of the first slotted top panel and a second slot of the first slotted top panel. The second slotted top panel includes a first slot of the second slotted top panel and a second slot of the second slotted top panel. The first slot of the first slotted top panel receives the first sliding top panel terminal edge. The second slot of the first slotted top panel receives the second sliding top panel terminal edge. The first slot of the second slotted top panel receives the second sliding top panel terminal edge. The second slot of the second slotted top panel receives the first sliding top panel terminal edge when the four top panels are posited to close the box.

In one form, the first slotted top panel has a first cutout. The cutout is adjacent to a hinged connection of the first slotted top panel to the second side panel. The second slotted top panel has a second cutout adjacent to a hinged connection of the second slotted top panel and the fourth side panel.

In one form, the box further includes a bar. The bar has a first end and a second end. The bar has a first clip located at the first end and a second clip located at the second end. The first clip is positioned in the first cutout and the second clip positioned in the second cutout.

In one form, the first slot of the first slotted top panel includes a first slot of the first slotted top panel first cut. The first slot of the first slotted top panel first cut extends from the connection of the first slotted top panel to the second side panel toward the first slotted top panel terminal edge. The first slot of the first slotted top panel first cut is laterally displaced from a longitudinal midline of the first slotted top panel.

In one form, a first slot of the first slotted top panel second cut is connected to the first slot of the first slotted top panel first cut and extends to a first slot end.

In one form, a first slot flap is located adjacent the first slot of the first slotted top panel second cut, and a second slot flap is located adjacent to the first slot of the first slotted top panel first cut.

In one form, a third slot flap is adjacent a third cut. The third cut forms a portion of the second slot of the first slotted top panel.

In one form, a fourth slot flap is adjacent a fourth cut. The fourth cut forms a portion of the second slot of the first slotted top panel.

In one form the box further includes a locking tab adjacent the second slot of the first slotted top panel, and a locking slot in the second sliding top panel. The locking tab is positioned over the locking slot when the box is closed.

In one form, the first sliding top panel is tapered from the connection to the first side panel towards the first sliding top panel terminal edge.

In one form, the invention is directed to a box having four side panels and four top panels. A first side panel is hingeably connected to a first sliding top panel. A second side panel is hingeably connected to a first slotted top panel. A third side panel is hingeably connected to a second sliding top panel. A fourth side panel hingeably connected to a second slotted top panel. The first sliding top panel has a first sliding top panel terminal edge. The second sliding top panel has a second sliding top panel terminal edge. The first sliding top panel has a first sliding top panel fold line located between a connection to the first side panel and the first sliding top panel terminal edge. The second sliding top panel has a second sliding top panel fold line located between a connection to the third side panel and the second sliding top panel terminal edge. The first sliding top panel tapers in width from the respective fold line to the respective terminal edge. The second sliding top panel tapers in width from the respective fold line to the respective terminal edge. The first slotted top panel has a respective first slot for receiving the terminal edge of the first sliding top panel and a respective second slot for receiving the terminal edge of the second sliding top panel.

In one form, the second slotted top panel has a respective first slot for receiving the terminal edge of the first sliding top panel and a respective second slot for receiving the terminal edge of the second sliding top panel.

In one form, the first slot of first slotted top panel and the first slot of the second slotted top panel have respective arcuate portions. The arcuate portion of the first slot of the first slotted top panel engages a lateral edge of the first sliding top panel and the arcuate portion of the first slot of the second slotted top panel engages a lateral edge of the second sliding top panel when the box is closed.

In one form, the box further includes a bar. The bar has a first end and a second end. The bar includes a first clip located at the first end and a second clip located at the second end. The first clip is positioned in a first cutout. The cutout is adjacent to a hinged connection of the first slotted top panel to the second side panel. The second clip is positioned in a second cutout adjacent to a hinged connection of the second slotted top panel and the fourth side panel.

In one form, the bar has depressions to accept portions of the first sliding top panel and the second sliding top panel where the bar is exposed by the first cutout and second cutout.

In one form, the second slotted top panel has a respective first slot for receiving the terminal edge of the second sliding top panel and respective second slot for receiving the terminal edge of the first sliding top panel.

In one form, a first slot flap is adjacent a first portion of the first slot of the first slotted top panel, a second slot flap is adjacent a second portion of the first slot of the first slotted top panel, a third slot flap is adjacent a first portion of the second slot of the first slotted top panel, and a fourth slot flap is adjacent to a second portion of the second slot of the first slotted top panel.

In one form, a respective first slot flap is adjacent to a respective first portion of the first slot of the second slotted top panel, a respective second slot flap is adjacent to a respective second portion of the first slot of the second slotted top panel, a respective third slot flap is adjacent a respective first portion of the second slot of the first slotted top panel, and a respective fourth slot flap is adjacent to a respective second portion of the second slot of the first slotted top panel.

In one form, a first locking tab is adjacent the second slot of the first slotted top panel and a second locking tab is adjacent the second slot of the second slotted top panel.

In one form, the invention is directed to a box having a first sliding top panel, a second sliding top panel, a first slotted top panel, and a second slotted top panel. The first sliding top panel has a terminal edge and the second sliding top panel has a second terminal edge. The first slotted top panel has a first slot and a second slot. The second slotted top panel has a third slot and a fourth slot. The first slot has an adjacent first slot tab and adjacent second slot tab. The second slot has an adjacent third slot tab and an adjacent fourth slot tab. The third slot has an adjacent fifth slot tab and an adjacent sixth slot tab. The fourth slot has an adjacent seventh slot tab and an adjacent eighth slot tab. The first slot and fourth slot receive the second terminal edge and the second slot and third slot receive the first terminal edge when the box is closed. The first slotted top panel further includes a first cutout and the second slotted top panel includes a second cutout. The first cutout is located on a hinged connection to a first side panel and the second cutout is located on a hinged connection to a second side panel.

These and other advantages will be disclosed in detail throughout this document.

DETAILED DESCRIPTION OF THE PREFERRED EMBODIMENT

Figure 1A:
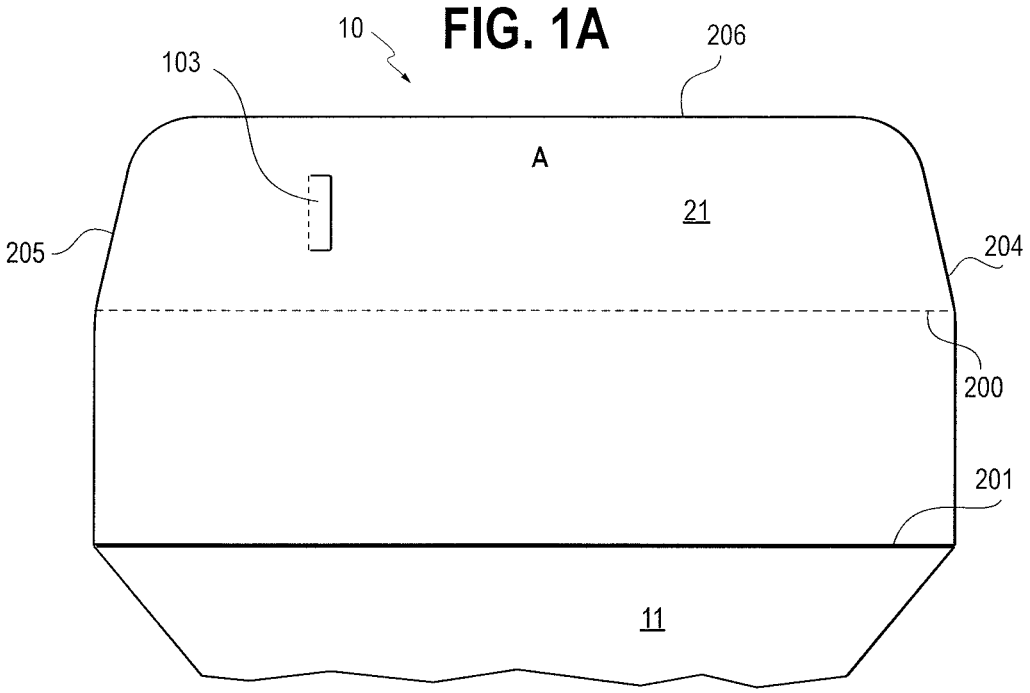
FIG. 1A is an illustration of a sliding panel of the present invention.
Figure 1B:
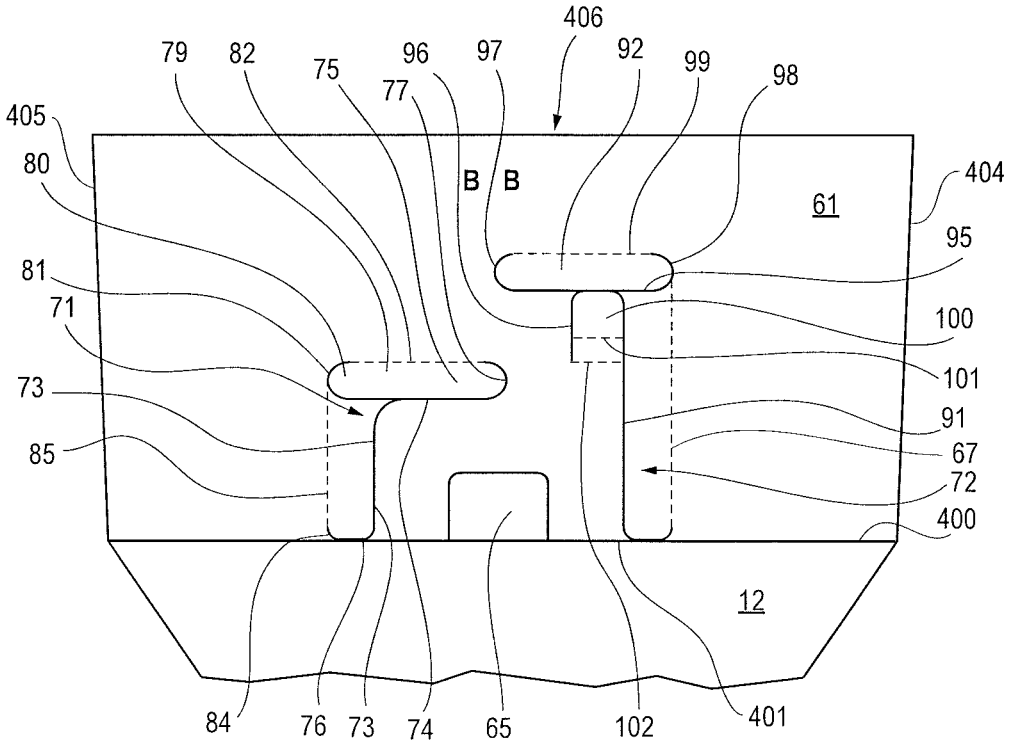
FIG. 1B is an illustration of a slotted panel of the present invention.
Figure 1C:
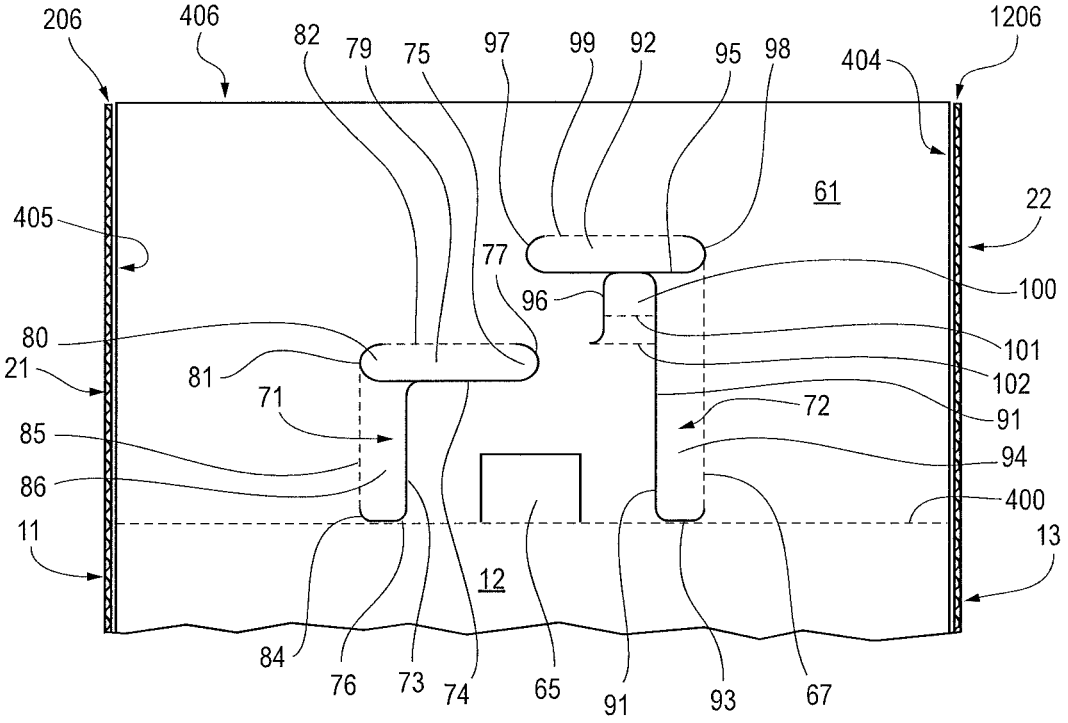
FIG. 1C is a partial side view illustration of a box of the present invention.
Figure 2:
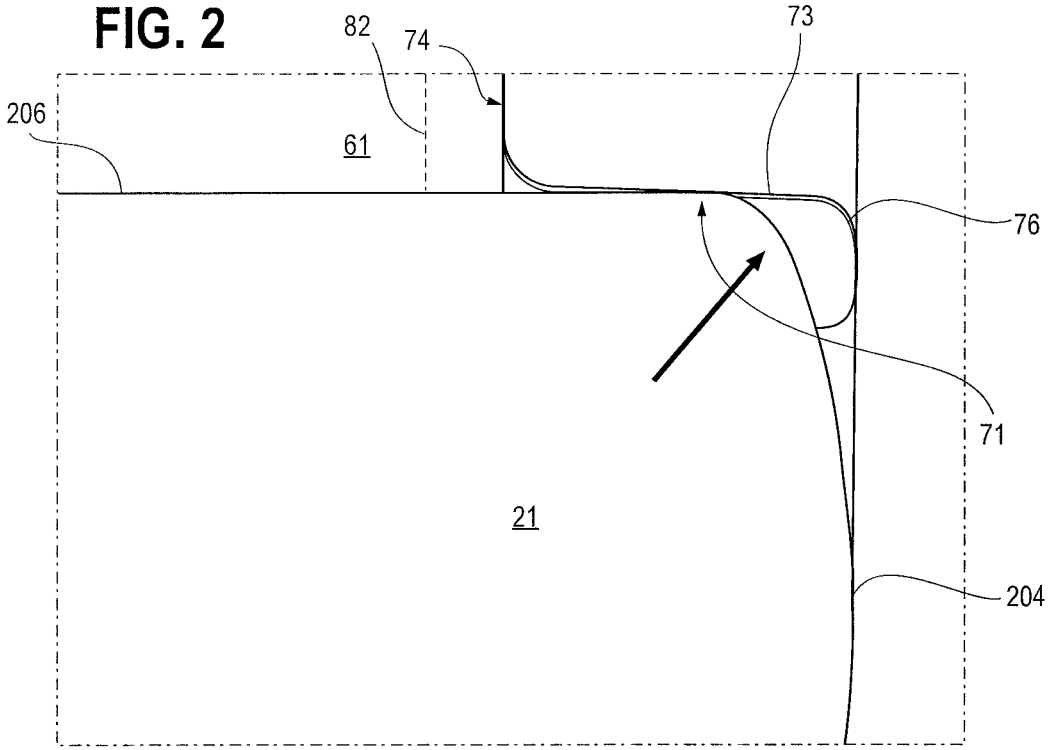
FIG. 2 is a close-up illustration of the top of the box showing the contoured edges of a sliding panel inserted into a first slot.
Figure 3:
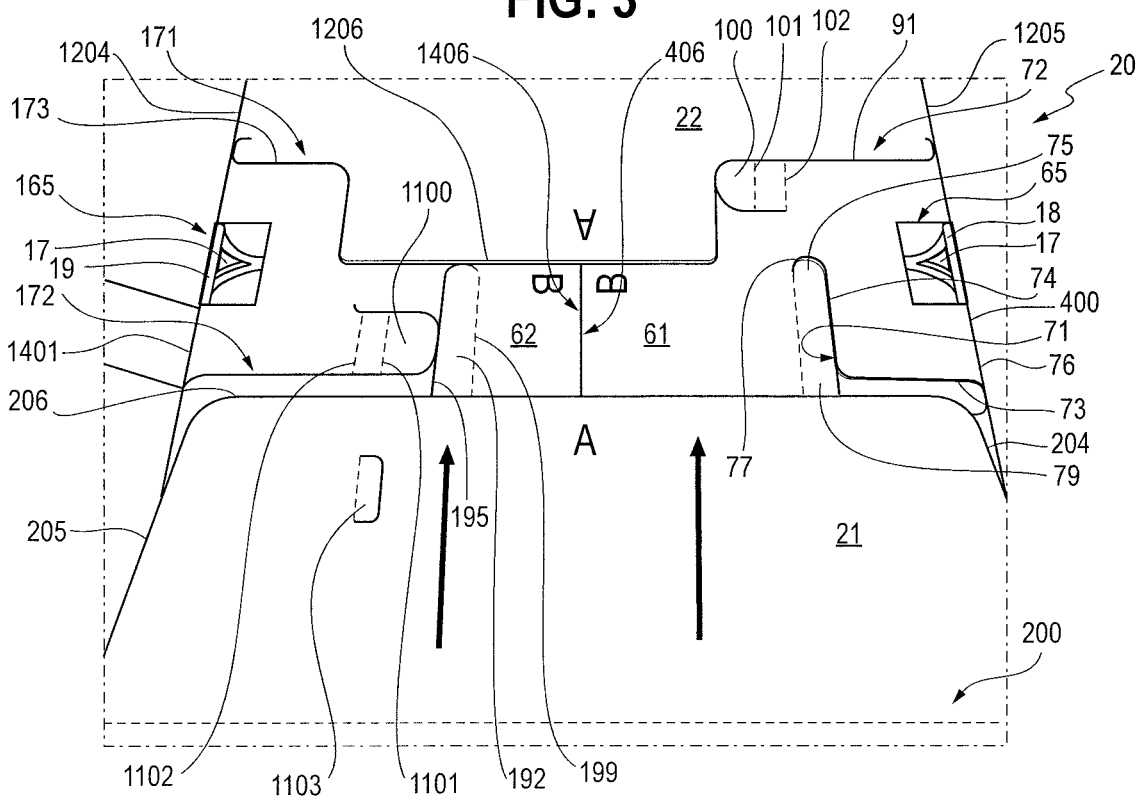
FIG. 3 is an illustration of the top of the box showing the second sliding panel inserted into the slots of the first and second slotted panels and a sliding panel being inserted into slots.
Figure 4:
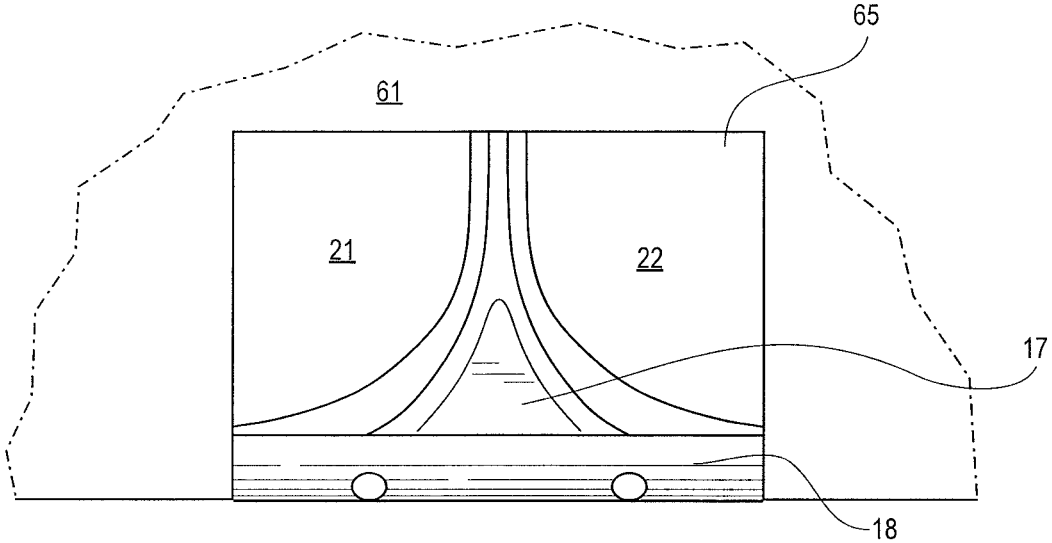
FIG. 4 is a close-up illustration of the contoured edges of the sliding panels fitting into a portion of a bar spanning the opening of the box.
Figure 5:
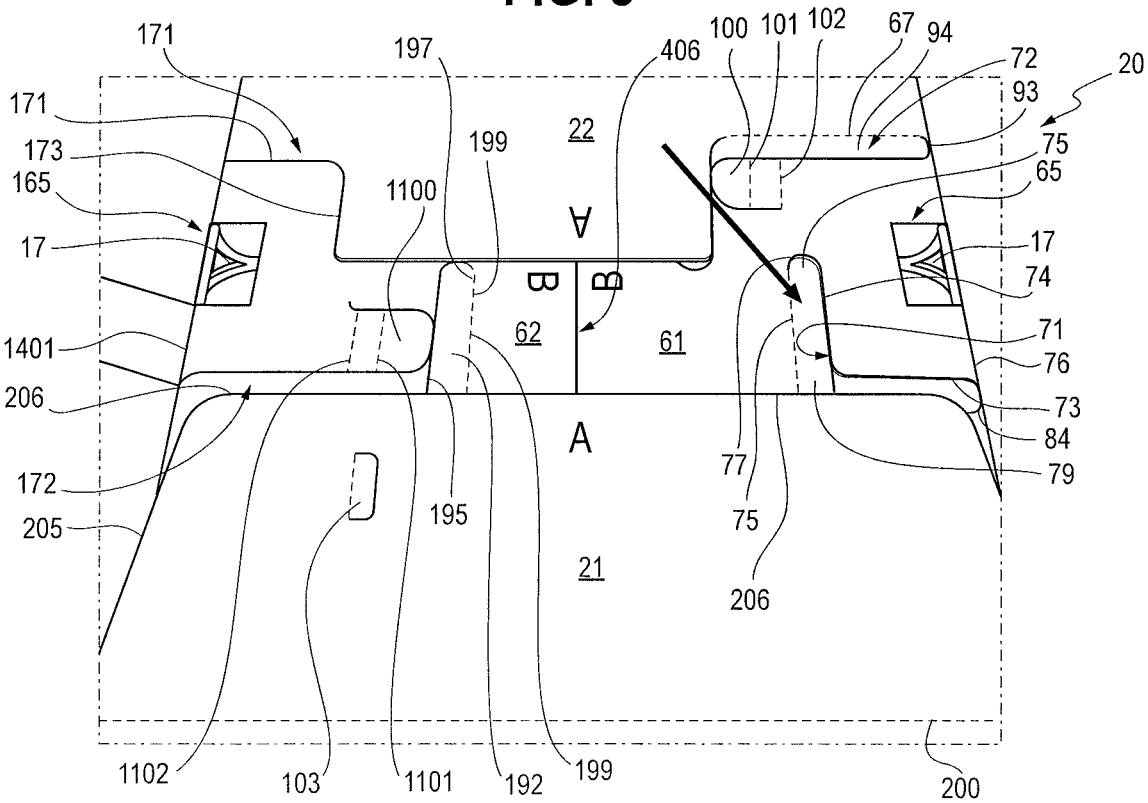
FIG. 5 is an illustration of the top of the box showing the offset nature of the slots with reference to a sliding panel.
Figure 6:
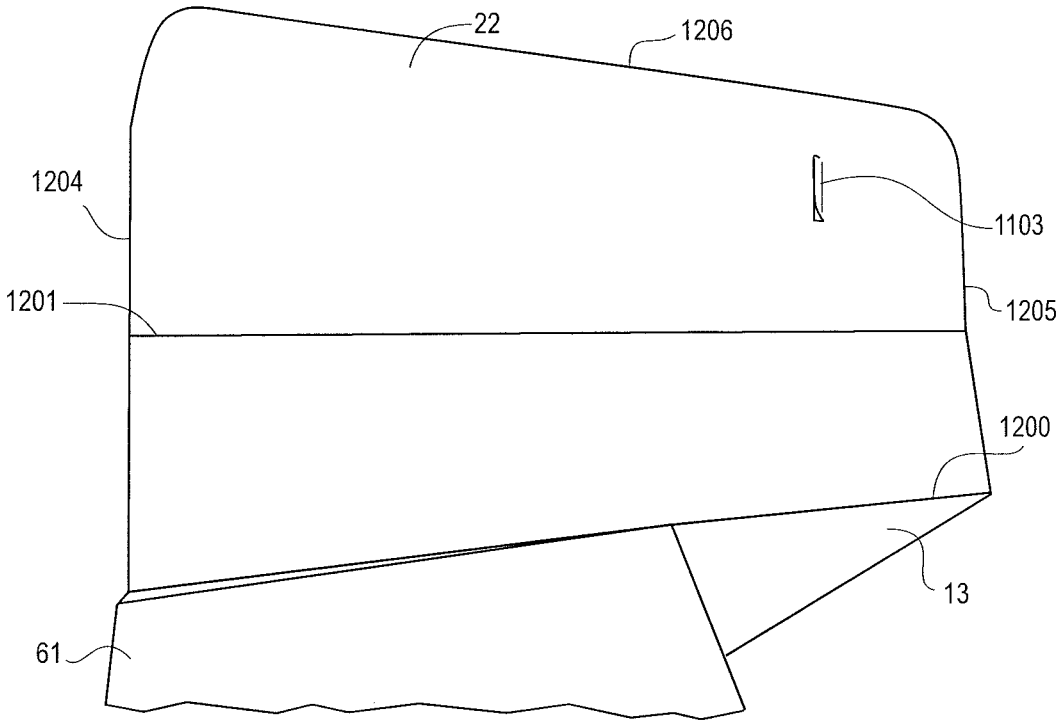
FIG. 6 is an illustration of the underside of sliding panel showing the transverse line of weakness and the slot for receiving the locking tab of a slotted panel.
Figure 7:
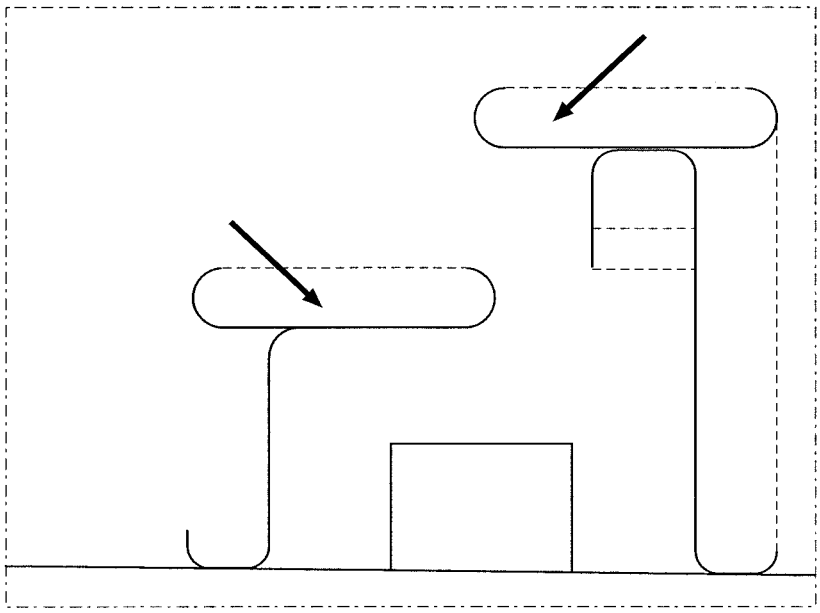
FIG. 7 is an illustration of a slotted panel highlighting the offset arrangement of the slots on the panel.
Figure 8:
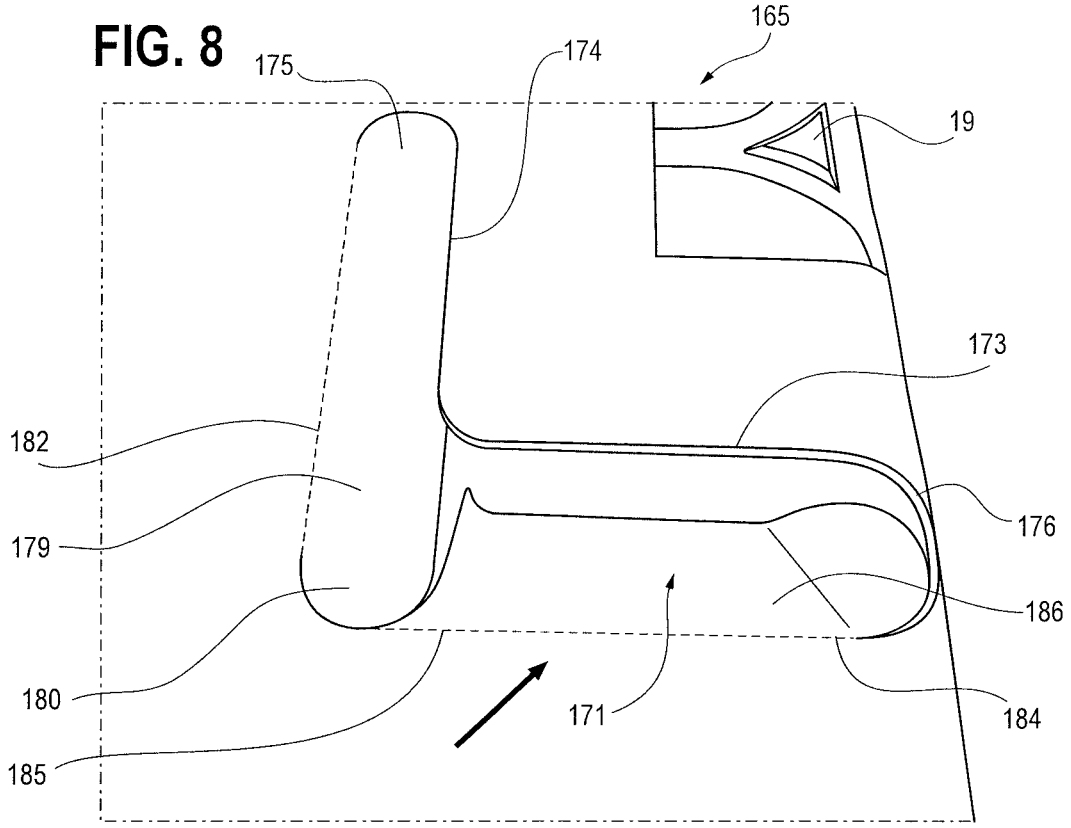
FIG. 8 is an illustration of the line of weakness defining a first slot flap on a slotted panel.
Figure 9:
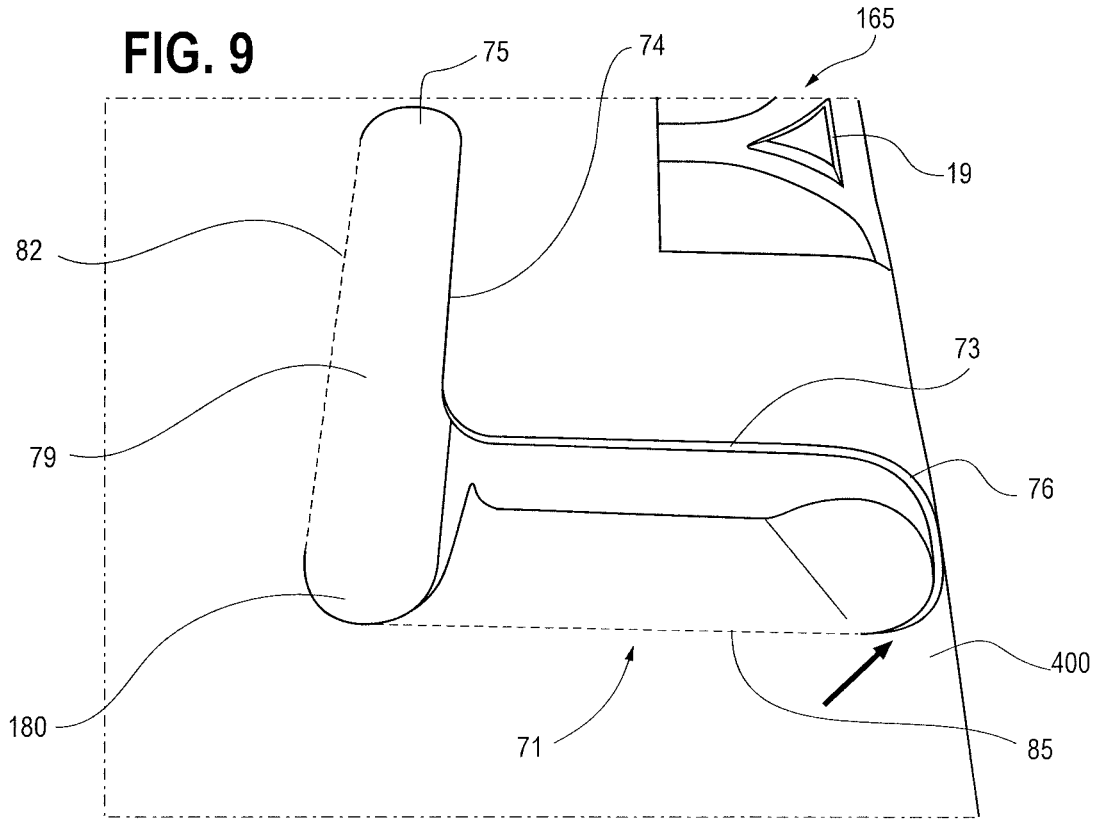
FIG. 9 is an illustration of the arcuate or rounded edges of the first slot end and the first slot flap on a slotted panel.
Figure 10:
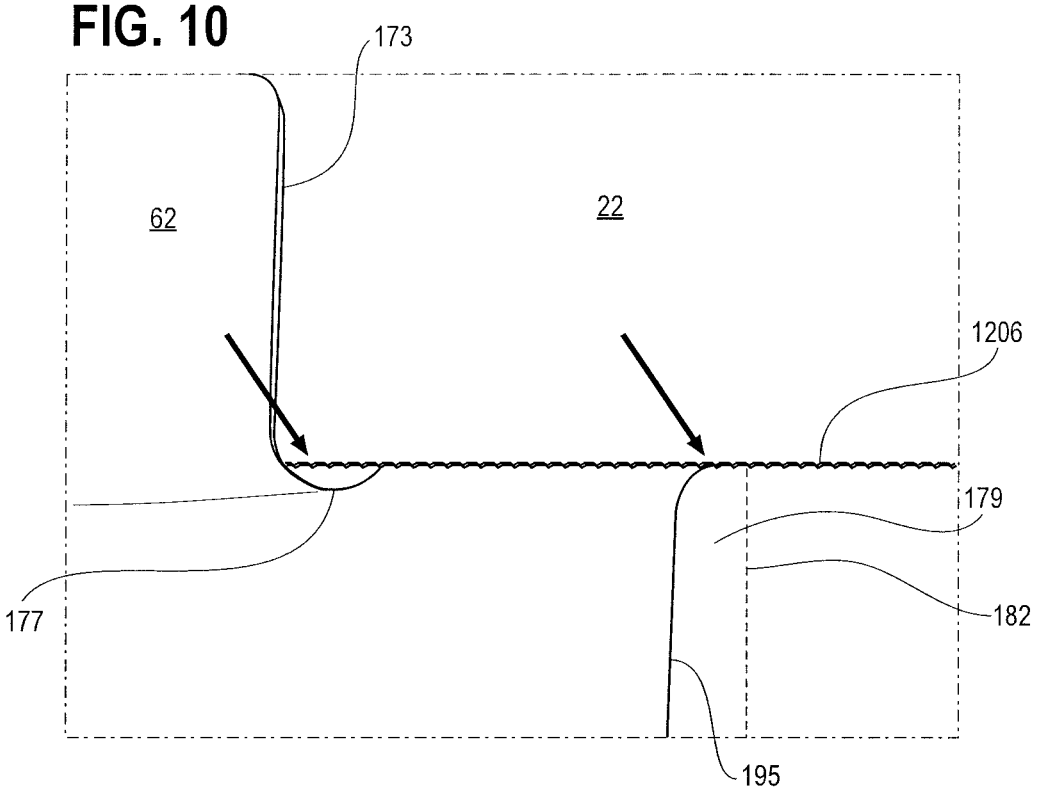
FIG. 10 is a close-up illustration of the arcuate or rounded end of a slot demonstrating accommodation of the terminal end of a sliding panel.
Figure 11:
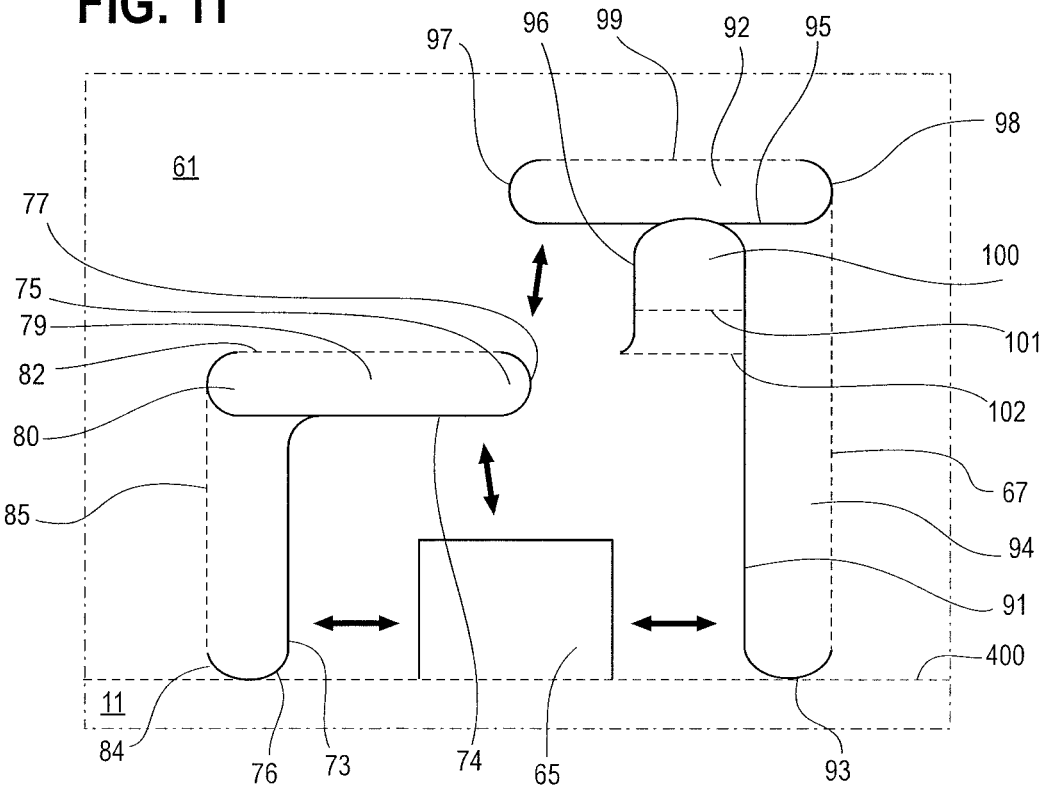
FIG. 11 is an illustration of a portion of a slotted panel highlighting the integrity created by spacing of the cuts in the panel.
Figure 12:
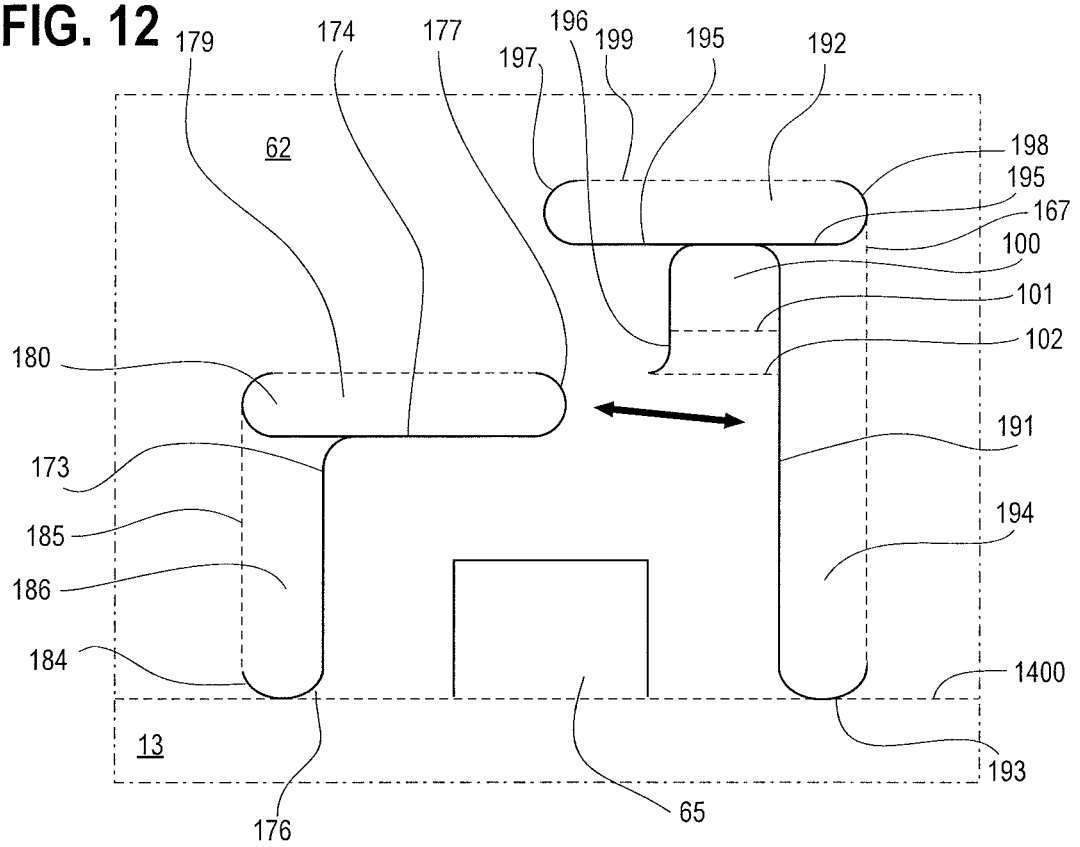
FIG. 12 is an illustration of a portion of a slotted panel highlighting the thicker securing section created by the distance between the end of the first slot and the cuts creating the locking tab of a slotted panel.
Figure 13:
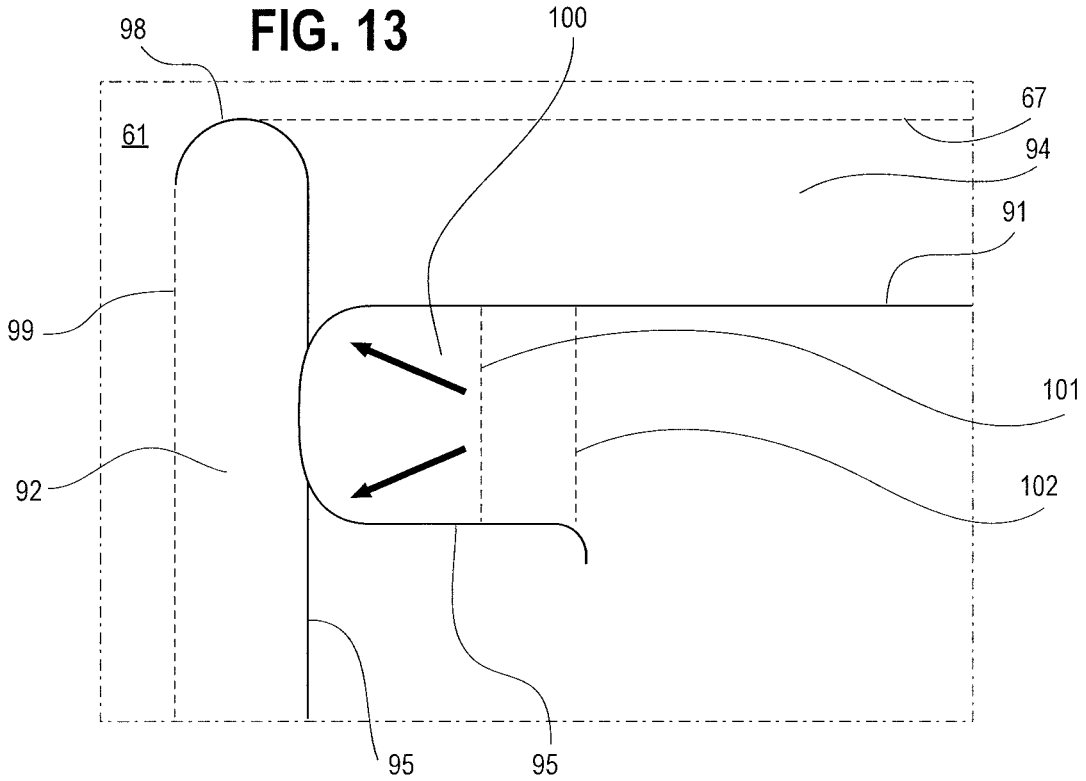
FIG. 13 is a close-up illustration of a locking tab.
Figure 14:
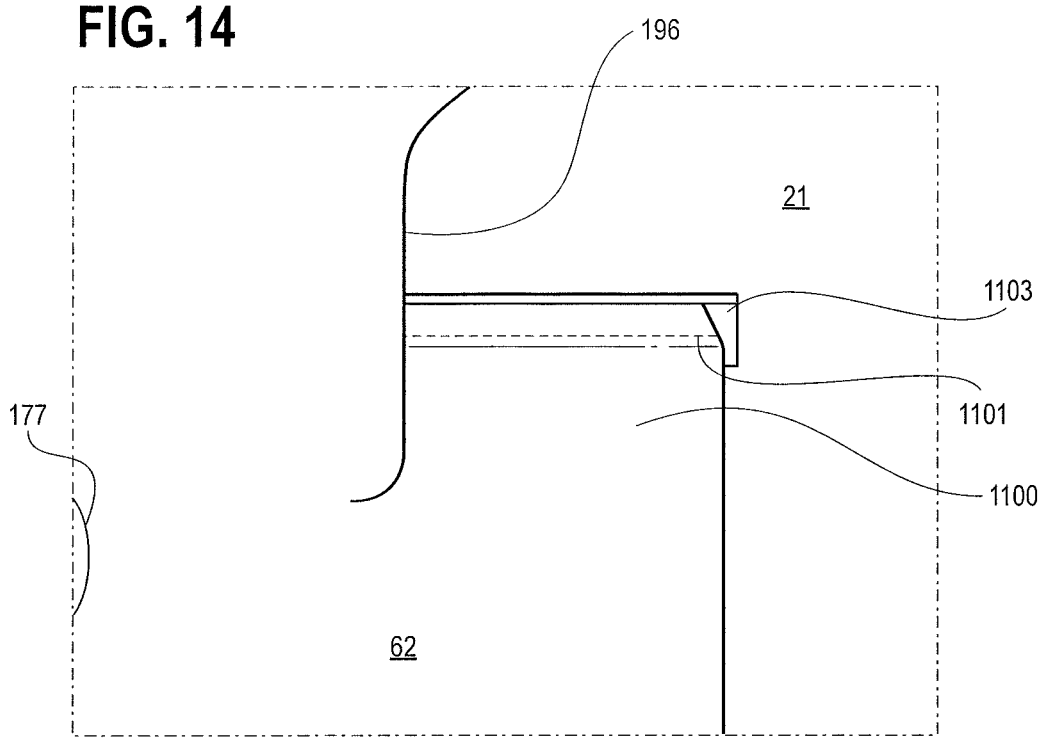
FIG. 14 is a close-up illustration of a locking tab inserted into a locking tab slot.
Figure 15:
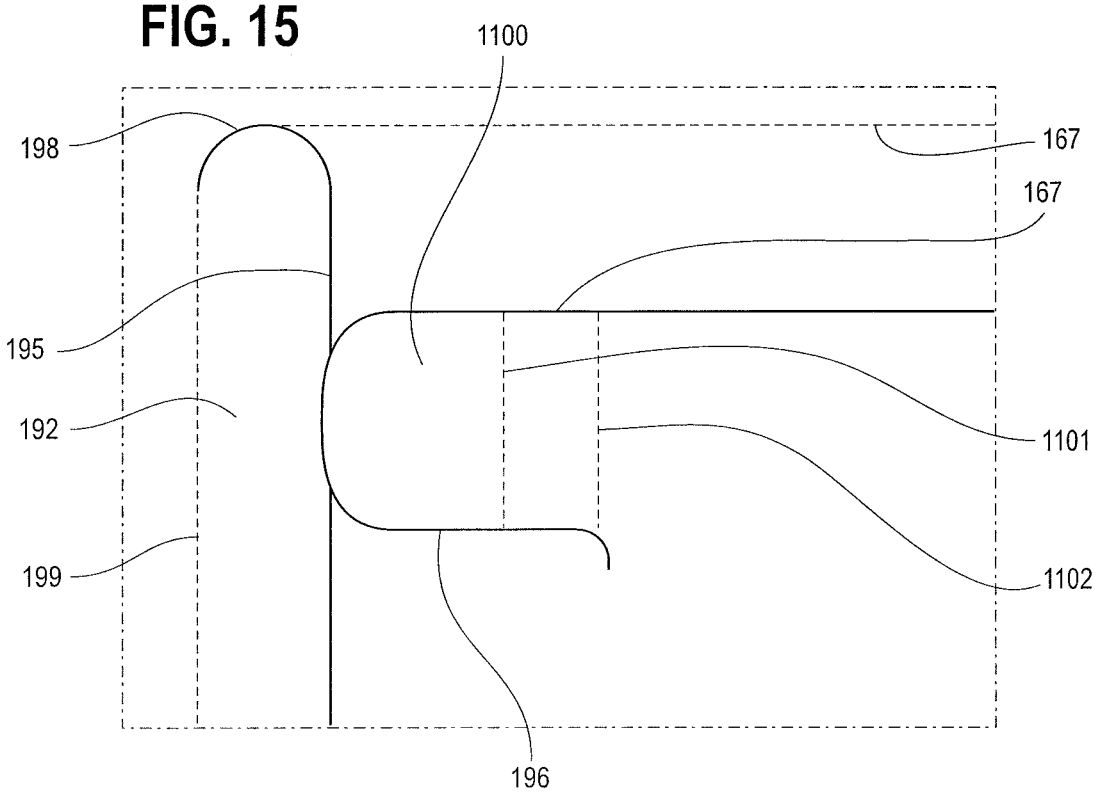
FIG. 15 is a close-up illustration of the rounded or arcuate cut or base of the locking tab.

With reference to the Figures, in some embodiments the box 10 includes a first side panel 11 and a second side panel 12 and a third side panel 13 and a fourth side wall 14, all connected together to define a space therebetween for receiving product or contents. The box 10 may include a box bottom 15. The bottom 15 may be a separate structure placed over a bottom opening defined by the four side panels 11-14. In some embodiments, the bottom opening may be closed by a bottom panel 16 or a plurality of bottom panels that span across the bottom opening defined by the four side panels to close the bottom of the box. The bottom 15 may be formed by any structures known in the art. The side panels 11-14 may be formed of any material used to make boxes or containers, such as corrugated paper, fiber, or plastic.

In some embodiments the box includes a top 20 formed by four panels. The four panels may include a first sliding panel 21 and a second sliding panel 22, and a first slotted panel 61 and a second slotted panel 62.

The first sliding panel 21 in some embodiments is formed as an extension of the first side panel 11 and joined thereto at a proximal end by a line of weakness such as a fold line 200. The second sliding panel 22 is formed as an extension of the third side panel 13 and joined thereto at a proximal end by a fold line 201. The direction from the proximal end of a panel to the terminal end is considered a longitudinal direction. The direction from a lateral edge to another lateral edge on a panel is considered a transverse direction. The longitudinal direction on a panel and the transverse direction may be perpendicular to one another.

The first sliding panel 21 is further defined by two lateral edges 204 and 205 extending from the fold line 200 to a terminal edge 206. The terminal edge 206 is shorter in length than the fold line. This relationship may create a taper such that the panel is narrower at the terminal edge 206 and widens between the lateral edges 204 and 205 and as one moves towards the fold line 200. A lateral edge 204 or 205 and the terminal edge 206 may meet or be joined by a contour, arcuate, or curved portion edge. In some embodiments, the length of the first sliding panel 21 between the fold line 200 and the terminal edge 206 is such that it extends half way across the opening of the top 20 of the box 10.

In some embodiments of the invention the first sliding panel 21 includes a transverse fold line 201. The transverse fold line 201 may be located between the lateral edges 204 and 205 and may extend to the lateral edges 204 and 205. In some embodiments the transverse fold line 201 may be parallel to the fold line 200 attaching the first sliding panel 21 to the first side panel 11. The transverse fold line 201, and any fold line of the invention, may be formed by a line of weakness.

The second sliding panel 22 may have features, layout, and construction similar to the first sliding panel 21. The second sliding panel 22 in some embodiments is formed as an extension of the third side panel 13 and joined thereto at a proximal end by a line of weakness such as a fold line 1200. As with the other panels described herein, the direction from the proximal end of a panel to the terminal end is considered a longitudinal direction. The direction from a lateral edge to another lateral edge on a panel is considered a transverse direction. The longitudinal direction on a panel and the transverse direction may be perpendicular to one another.

The second sliding panel 22 is further defined by two lateral edges 1204 and 1205 extending from the fold line 1200, where the second sliding panel 22 is joined to the third side panel 13, to a terminal edge 1206. The terminal edge 1206 of the second sliding panel 22 is shorter in length than the fold line 1200. This relationship may create a taper such that the second sliding panel 22 is narrower at the terminal edge 1206 and widens between the lateral edges 1204 and 1205 as one moves towards the fold line 1200. A lateral edge 1204 and 1205 and the terminal edge 1206 may meet or be joined by a contour, arcuate, or curved portion edge. In some embodiments, the length of the second sliding panel 22 between the fold line 1200 and the terminal edge 1206 is such that it extends half way across the opening of the top of the box 10.

As the second sliding panel 22 and the first sliding panel 21 cooperate to close the top of the box 10, in some embodiments the first sliding panel 21 will be of a length that it extends less than half way across the top of the box, and the second sliding panel 22 will be of a length that it extends more than half way across the box 10. One skilled in the art will recognize that the lengths of the first and second sliding panels 21 and 22 may be adjusted so that in combination, they effectively cooperate to close the top of the box 10.

In some embodiments of the invention the second sliding panel 22 includes a transverse fold line 1201. The transverse fold line 1201 may be located between the lateral edges 1204 and 1205 and may extend to the lateral edges 1204 and 1205. In some embodiments the transverse fold line 1201 may be parallel to the fold line 1200 attaching the second sliding panel 22 to the third side panel 13. The transverse fold line 1201 may be formed by a line of weakness.

In some embodiments of the invention, the box 10 includes a first slotted panel 61 and a second slotted panel 62. The first slotted panel 61 is formed as an extension of the second side panel 12 and the second slotted panel is formed as an extension of the fourth side panel 14. The first slotted panel 61 is coupled to the second side panel 12 by a fold line at a proximal end of the first slotted panel 61. The second slotted panel 62 is similarly joined to the fourth side panel 14 by a fold line at a proximal end of the second slotted panel 62.

As with the first and second sliding panels 21 and 22, the first and second slotted panels 61 and 62 are similar in construction and layout. In some embodiments of the invention, the first slot 71 of the first slotted panel opposes the second slot 172 of the second slotted panel 62. In some embodiments of the invention, the second slot 72 of the first slotted panel 61 opposes the first slot 171 of the second slotted panel 62.

In some embodiments, the first slotted panel 61 is defined by two lateral edges 404 and 405 joined by a terminal end or edge 406. The transition of a lateral edge 404 or 405 to the terminal edge 406 may be curved, arced, or contoured. In some embodiments, shape of the transition is complimentary to the shape or contour of a portion of a bar 17 that extends across the top opening of the box 10.

The first slotted panel 61 includes a cutout 65. The cutout is located adjacent the fold line 400 and may generally be centered between the lateral edges 404 and 405. However, the placement of the cutout 65 may be determined by the position of the bar 17 that spans from the second side panel 12 to the fourth side panel 14, and may not be centered between the lateral edges of the first slotted panel 61. The cutout 65 overlies the bar 17 and is sized to allow a clip 18 of the bar 17 to be placed over an edge of the second side panel 12 and a second clip 19 to be placed over an edge of the fourth side panel 14.

In some embodiments, the first slotted panel includes a first slot 71 and a second slot 72. The first slot 71 receives a terminal end of the first sliding panel 21 and the second slot receives a terminal end of the second sliding panel 22 when the box 10 is closed.

In some embodiments the first slot 71 is formed by a first cut 73 that begins from at, near, or adjacent to the fold line 400. The first cut 73 begins at a position laterally displaced from the longitudinal midline of the first panel 61. The lateral displacement is no more than ¼ the distance between the longitudinal midline and the lateral edge of the first slotted panel 61. In other embodiments, the displacement of the first cut 73 is referenced to the cutout 65.

From its beginning or start point, the first cut 73 continues or extends toward the terminal end of the first slotted panel 61, but does not reach the terminal end 406 of the slotted panel 61. In the most preferred embodiment, the first cut 73 goes no further than ¼ the distance from the fold line 400 to the terminal end 406.

In some embodiments a second cut 74 is made from along the length of the first cut 73 toward the longitudinal midline of the first slotted panel 61. It is preferred that the second cut 74 extend past the longitudinal middle of the first slotted panel 61 to create a first slot end 75. In some embodiments, the second cut 74 extends far enough to allow the first sliding panel 21 to lay flat across the top of the box 10.

It is understood that the first cut 73 and the second cut 74 may be considered a single continuous cut. For convenience they are described as two cuts to better define the change in direction exhibited by one cut with reference to the other. The first and second cuts 73 and 74 may alternately be described as a cut with a first and second portion. In some embodiments, the transition for the first cut 73 to the second cut 74 is an arcuate or radius portion.

In some embodiments of the invention, there is a cut that extends from slot starting point 76 near or adjacent to the fold line 400 to the first slot end 75. Such a cut may take any shape or path. For instance, the cut may be linear, contour, arcuate, or any other shape going from the slot starting point 76 to the slot end 75.

In some embodiments, the first slot end 75 includes an arcuate portion or cut 77. In the most preferred embodiment, the arcuate portion has a radius of approximately ¼ inch. It is preferred the arcuate cut 77 is a semi-circle. The arcuate cut 77 arcs away from the second cut 74 towards the terminal end of the first slotted panel 61.

In some embodiments, the second cut 74 extends from the first slot end 75 to a first slot flap end 80. The first slot flap end 80 and the second cut may be laterally displaced from the first slot end 75. The first slot end 75 and the first slot flap end 80 may be laterally displaced on opposite sides of the first cut 71. The first slot flap end 80 may include an arcuate portion 81. The arcuate portion is most preferably at a radius of ¼ inch. It is also preferable in some embodiments to have the arcuate portion of the first slot flap end 80 have the same radius as the radius of the arcuate portion of the first slot end 75 arcuate cut 77. In some embodiments, a line of weakness 82 extends from the first slot end arcuate portion or cut 77 to the first slot flap arcuate portion 81. The line of weakness 82, the second cut 74, the first slot end 75 and the first slot flap end 80 define a first slot flap 79. The line of weakness allows the first slot flap 79 to be flexed downward or upwards.

In some embodiments of the invention, the first cut 73 may include an end or portion that extends along or near fold line 400 and arc or turn up towards the terminal end 406. The arcuate portion 84 may be connected to the first slot flap arcuate portion 81 by a line of weakness 85, to create or define a second slot flap 86. The second slot flap 86 and the first slot flap 79 collectively cooperate to create an opening or gap or displacement about the perimeter of the first slot 71 to better receive the sliding panel. A similar arrangement is also created about the perimeter of the second slot 72 by other flap structures defined herein.

In some embodiments, the first panel 61 includes second slot 72 that includes a third cut 91 generally extending toward the terminal end or edge 406 and beginning from at, near or adjacent the fold line 400. The third cut 91 is longer than the first cut 73. In the most preferred embodiment, the third cut 91 furthest point from the fold line 400 being twice the distance of the first cut's farthest point from the fold line 400. The third cut 91 may be straight, curved, arcuate, or of any configuration.

In some embodiments, the third cut 91 may include a lateral portion 93 near the fold line 400 extending laterally towards a lateral edge 404 of the panel. In some embodiments the lateral portion 93 may extend up towards the terminal end 406. The lateral portion 93 may be connected to the second terminal end 98 of the fourth cut 95 by a line of weakness 67 to define a third slot flap 94.

In some embodiments, the third cut 91 terminates at or near a fourth slot flap 92. The fourth slot flap 92 is similar in construction to the first slot flap discussed previously and may bend upwards and downwards to better receive the terminal end of a sliding panel. The fourth slot flap 92 is formed by a fourth cut 95. The fourth cut 95 extends transversely across the first slotted panel 61. The fourth cut 95 may terminate at either or both ends in a arcuate shape or cut.

In some embodiments, the fourth cut 95 has a first terminal end 97 and a second terminal end 98. The terminal ends 97 or 98 may be arcuate cuts that are toward the terminal edge 406 of the first slotted panel 61. The arcuate cuts may have any radius, but a radius of ¼ inch is preferred. It is also preferred that the terminal end 97 and 98 arcuate cuts are joined by a line of weakness 99 to fully define the fourth slot flap 92.

In some embodiments, the first terminal end 97 arcuate cut is positioned so that it is generally over or in-line with the first slot flap end 77. The second end 98 arcuate cut is positioned away from the fourth cut line 91 by the same distance as the first end 97 arcuate cut.

A sixth cut 96 extends away from the fifth cut 95 towards the fold line 400 and generally parallel to the fourth cut 91. The fifth cut 96 may include an arcuate portion where it joins the fifth cut and the third cut 91 may also have an arcuate portion where it joins the fourth cut 95. The fifth cut 96 may also include an arcuate portion at its end closest to the proximate end of the first slotted panel 61. Such arcuate portion may be a stress reliever to reduce any tearing of the panel at the end of the fifth cut 96.

The area between the third cut 91, the fourth cut 95, and the fifth cut 96 defines a locking tab 100. The locking tab 100 may include a first locking tab fold line 101 to allow the locking tab 100 to better fold downward so that the locking tab 100 may be inserted into locking slot 103 on the sliding panel that lies underneath when the box 10 is closed. In some embodiments, the locking tab includes a second locking tab fold line 102 located near the arcuate portion of the fifth cut 96.

The second slotted panel 62 may be of a similar layout and construction as the first slotted panel 61. Thus figures showing features on one slotted panel may apply equally to the first or second slotted panel. One skilled in the art will recognize that when the first panel 61 and second panel 62 are across from one another on the top of the box, the first slot 71 of the first panel 61 opposes the second slot 172 of the second panel 62.

In some embodiments, the second slotted panel 62 is defined by two lateral edges 1404 and 1405 joined by a terminal end or edge 1406. The transition of a lateral edge 1404 or 1405 to the terminal edge 1406 may be curved, arced, or contoured. In some embodiments, shape of the transition is complimentary to the shape or contour of a portion of a bar 17 that extends across the top opening of the box 10.

In some embodiments, the second slotted panel 62 includes a cutout 165. The cutout is located adjacent the fold line 1400 and may generally be centered between the lateral edges 1404 and 1405. However, the placement of the cutout 165 may be determined by the position of the bar 17 that spans from the second side panel 12 to the fourth side panel 14, and may not be centered between the lateral edges 1404 and 1405 of the second slotted panel 62. The cutout 165 overlies the bar 17 and is sized to allow a clip 18 of the bar 17 to be placed over an edge of the second side panel 12 and a second clip 19 to be placed over an edge of the fourth side panel 14.

In some embodiments, the second slotted panel 62 includes a first slot 171 and a second slot 172. The first slot 171 receives a terminal end of the second sliding panel 22 and the second slot 172 receives a terminal end of the first sliding panel 21 when the box 10 is closed. One skilled in the art will recognize this is the complementary arrangement as compared to the interaction of the slots of the first slotted panel 61 and the first and second sliding panels 21 and 22.

In some embodiments the first slot 171 is formed by a first cut 173 that begins from at, near, or adjacent to the fold line 1400. The first cut 173 begins at a position laterally displaced from the longitudinal midline of the second slotted panel 62. The lateral displacement is no more than ¼ the distance between the longitudinal midline and the lateral edge 1406 of the second slotted panel 62. In other embodiments, the displacement of the first cut 173 is referenced to the cutout 165.

From its beginning or start point, the first cut 173 continues or extends toward the terminal end of the second slotted panel 62, but does not reach the terminal end of the second slotted panel 62. In the most preferred embodiment, the first cut 173 goes no further than ¼ the distance from the fold line to the terminal end of the second slotted panel 62.

In some embodiments a second cut 174 is made from along the length of the first cut 173 toward the longitudinal midline of the second slotted panel 62. It is preferred that the second cut 174 extends past the longitudinal middle of the second slotted panel 62 to create a first slot end 175. In some embodiments, the second cut 174 extends far enough to allow the second sliding panel 22 to lay flat across the top of the box 10 when the second sliding panel terminal end is fully inserted into the first slot 171.

It is understood that the first cut 173 and the second cut 174 may be considered a single continuous cut. For convenience they are described as two cuts to better define the change in direction exhibited by one cut with reference to the other. Such may be the case for any of the cuts that are joined or connected or otherwise appear to be continuous in this specification. The first and second cuts 173 and 174 may alternately be described as a cut with a first and second portion. In some embodiments, the transition for the first cut 173 to the second cut 174 is an arcuate or radius portion.

In some embodiments of the invention, there is a cut that extends from slot starting point 176 near or adjacent to the fold line to the first slot end 175. Such a cut may take any shape or path. For instance, the cut may be linear, contour, arcuate, or any other shape going from the slot starting point 176 to the slot end 175.

In some embodiments, the first slot end 175 includes an arcuate portion or cut 177. In the most preferred embodiment, the arcuate portion has a radius of approximately ¼ inch. It is preferred the arcuate cut 177 is a semi-circle. The arcuate cut 177 arcs away from the second cut 174 towards the terminal end of the second slotted panel 62.

In some embodiments, the second cut 174 extends from the first slot end 175 to a first slot flap end 180. The first slot flap end 180 and the second cut 174 may be laterally displaced from the first slot end 175. The first slot flap end 180 may include an arcuate portion 181. The arcuate portion 181 is most preferably at a radius of ¼ inch. It is also preferable in some embodiments to have the arcuate portion of the first slot flap end 180 have the same radius as the radius of the arcuate portion of the first slot end 75 arcuate cut 77. In some embodiments, a line of weakness 182 extends from the first slot end arcuate portion 177 to the first slot flap arcuate portion 181. The line of weakness 182, the second cut 174, the first slot end 175 and the first slot flap end 180 define a first slot flap 179. The line of weakness 182 allows the first slot flap 179 to be flexed downward or upwards.

In some embodiments of the invention, the first cut 173 may include an end or portion that extends along or near fold line 1400 and arc or turn up towards the terminal end 1406. The arcuate portion 84 may be connected to the first slot flap arcuate portion 181 by a line of weakness 185, to create or define a second slot flap 186. The second slot flap 186 and the first slot flap 179 collectively cooperate to create an opening or gap or displacement about the perimeter of the first slot 171 to better receive the sliding panel. A similar arrangement is also created about the perimeter of the second slot 172 by other flap structures defined herein.

In some embodiments, the second slotted panel 62 includes second slot 172 for receiving a sliding panel. The second slot 172 includes a third cut 191 generally extending toward the terminal end 1406 and beginning from at, near or adjacent the fold line 1400. The third cut 191 is longer than the first cut 171. In the most preferred embodiment, the third cut 191 furthest point from the fold line 1400 being twice the distance of the first cut's 171 farthest point from the fold line 1400. The third cut 191 may be straight, curved, arcuate, or of any configuration.

In some embodiments, the third cut 191 terminates at or near a fourth slot flap 192. The fourth slot flap 192 is similar in construction to the first slot flap 92 discussed previously and may bend upwards and downwards to better receive the terminal end of a sliding panel. The fourth slot flap 192 is formed by a fourth cut 195. The fourth cut 195 extends transversely across the second slotted panel 62. The fourth cut 195 may terminate at either or both ends in a arcuate shape or cut.

In some embodiments, the fourth cut 195 has a first terminal end 197 and a second terminal end 198. The terminal ends 197 or 198 may be arcuate cuts that are toward the terminal end of the second slotted panel 62. The arcuate cuts may have any radius, but a radius of ¼ inch is preferred. It is also preferred that the terminal end 197 and 198 arcuate cuts are joined by a line of weakness to fully define the second slot flap 192.

In some embodiments, the first terminal end 197 arcuate cut is positioned so that it is generally over or in-line with the first slot flap end 177. The second end 198 arcuate cut is positioned away from the third cut 191 by the same distance as the first end 197 arcuate cut.

In some embodiments a fifth cut 196 extends away from the fourth cut 195 towards the fold line and generally parallel to the third cut 191. The fifth cut 196 may include an arcuate portion where it joins the fourth cut 195 and the third cut 191 may also have an arcuate portion where it joins the fourth cut 195. The fifth cut 196 may also include an arcuate portion at its end closest to the proximate end of the second slotted panel 62. Such arcuate portion may be a stress reliever to reduce any tearing of the panel at the end of the fifth cut 196.

The area between the third cut 191, the fourth cut 195, and the fifth cut 196 defines a locking tab 1100. The locking tab 1100 may include a first locking tab fold line 1101 to allow the locking tab 1100 to better fold downward so that the locking tab 1100 may be inserted into locking slot 1103 on the sliding panel that lies underneath when the box 10 is closed. In some embodiments, the locking tab includes a second locking tab fold line 1102 located near the arcuate portion of the fifth cut 196.

The illustration of these particular embodiments should not be taken as restrictive in any way since a myriad of configurations and methods using the underlying invention can be realized from what has been disclosed in this provisional application.

The listed products, features and inventive embodiments described in this application should not be considered as limiting in any way since they can be applied to many products in many different configurations. The disclosed features of this application can be applied to products that enclose, package, transport, or carry goods. The disclosed invention and its features can exist in or function within the category of containers, packaging, and boxes of all types including but not limited to those made of paper, fiberboard, corrugated board, and any other material commonly used to make containers, packaging, and boxes.

The simplified illustrations are representative of possible construction and mechanical methods to obtain the desired features and improvements of the unit described within this application. The location of any detail, feature or material can be constructed in such a way to relocate its position as shown in the simplified illustrations (such as reversing the components positions and or assembly while leaving the main over all disclosed functionality the same or similar). The relocation and placement of certain features, or the elimination of certain components, or the addition of others referenced by description, or illustrated in this particular application are easily understood, and this application covers any and all of these alternative configurations as well The foregoing disclosure of specific embodiments is intended to be illustrative of the broad concepts comprehended by the invention.

The invention claimed is:

1. A box, the box including four side panels and four top panels, a first side panel hingeably connected to a first sliding top panel, a second side panel hingeably connected to a first slotted top panel, a third side panel hingeably connected to a second sliding top panel, and a fourth side panel hingeably connected to a second slotted top panel, the first sliding top panel having a first sliding top panel terminal edge, the second sliding top panel having a second sliding top panel terminal edge, the first sliding top panel including a first sliding top panel fold line located between a connection to the first side panel and the first sliding top panel terminal edge, the second sliding top panel including a second sliding top panel fold line located between a connection to the third side panel and the second sliding top panel terminal edge, the first slotted top panel includes a first slot of the first slotted top panel and a second slot of the first slotted top panel, the second slotted top panel includes a first slot of the second slotted top panel and a second slot of the second slotted top panel, the first slot of the first slotted top panel receiving the first sliding top panel terminal edge, the second slot of the first slotted top panel receiving the second sliding top panel terminal edge, the first slot of the second slotted top panel receiving the second sliding top panel terminal edge and the second slot of the second slotted top panel receiving the first sliding top panel terminal edge when the four top panels are posited to close the box, the first slot of the first slotted top panel includes a first slotted top panel first cut, the first slotted top panel first cut extending from the connection of the first slotted top panel to the second side panel toward the first slotted top panel terminal edge, the first slotted top panel first cut laterally displaced from a longitudinal midline of the first slotted top panel, further including a first slot flap located adjacent the first slot of the first slotted top panel second cut, and a second slot flap located adjacent to the first slot of the first slotted top panel first cut.

2. The box of claim 1, wherein the first slotted top panel includes a first cutout, the cutout being adjacent to a hinged connection of the first slotted top panel to the second side panel, and the second slotted top panel includes a second cutout adjacent to a hinged connection of the second slotted top panel and the fourth side panel.

3. The box of claim 2, further including a bar, the bar having a first end and a second end, the bar including a first clip located at the first end and a second clip located at the second end, the first clip positioned in the first cutout and the second clip positioned in the second cutout.

4. The box of claim 1, further including a first slotted top panel second cut, connected to the first slotted top panel first cut and extending to a first slot end.

5. The box of claim 1, further including a third slot flap adjacent a third cut, the third cut forming a portion of the second slot of the first slotted top panel.

6. The box of claim 5, further including a fourth slot flap adjacent a fourth cut, the fourth cut forming a portion of the second slot of the first slotted top panel.

7. The box of claim 1, further including a locking tab adjacent the second slot of the first slotted top panel, and a locking slot in the second sliding top panel, the locking tab positioned over the locking slot when the box is closed.

8. The box of claim 1, wherein the first sliding top panel is tapered from the connection to the first side panel towards the first sliding top panel terminal edge.

9. A box, the box including four side panels and four top panels, a first side panel hingeably connected to a first sliding top panel, a second side panel hingeably connected to a first slotted top panel, a third side panel hingeably connected to a second sliding top panel, and a fourth side panel hingeably connected to a second slotted top panel, the first sliding top panel having a first sliding top panel terminal edge, the second sliding top panel having a second sliding top panel terminal edge, the first sliding top panel including a first sliding top panel fold line located between a connection to the first side panel and the first sliding top panel terminal edge, the second sliding top panel including a second sliding top panel fold line located between a connection to the third side panel and the second sliding top panel terminal edge, the first sliding top panel tapering in width from the respective fold line to the respective terminal edge, the second sliding top panel tapering in width from the respective fold line to the respective terminal edge, the first slotted top panel having a respective first slot for receiving the terminal edge of the first sliding top panel, and a respective second slot for receiving the terminal edge of the second sliding top panel, the second slotted top panel including a respective first slot for receiving the terminal edge of the second sliding top panel and respective second slot for receiving the terminal edge of the first sliding top panel, further including a first slot flap adjacent a first portion of the first slot of the first slotted top panel, a second slot flap adjacent a second portion of the first slot of the first slotted top panel, a third slot flap adjacent a first portion of the second slot of the first slotted top panel, and a fourth slot flap adjacent to a second portion of the second slot of the first slotted top panel.

10. The box of claim 9, wherein the second slotted top panel includes a respective first slot for receiving the terminal edge of the first sliding top panel and a respective second slot for receiving the terminal edge of the second sliding top panel.

11. The box of claim 10, wherein the first slot of first slotted top panel and the first slot of the second slotted top panel include respective arcuate portions, the arcuate portion of the first slot of the first slotted top panel engages a lateral edge of the first sliding top panel and the arcuate portion of the first slot of the second slotted top panel engages a lateral edge of the second sliding top panel when the box is closed.

12. The box of claim 10, further including a first locking tab adjacent the second slot of the first slotted top panel and a second locking tab adjacent the second slot of the second slotted top panel.

13. The box of claim 9, further including a bar, the bar having a first end and a second end, the bar including a first clip located at the first end and a second clip located at the second end, the first clip positioned in a first cutout, the cutout being adjacent to a hinged connection of the first slotted top panel to the second side panel, the second clip being positioned in a second cutout adjacent to a hinged connection of the second slotted top panel and the fourth side panel.

14. The box of claim 13, wherein the bar includes depressions to accept portions of the first sliding top panel and the second sliding top panel where the bar is exposed by the first cutout and second cutout.

15. The box of claim 9, further including a respective first slot flap adjacent to a respective first portion of the first slot of the second slotted top panel, a respective second slot flap adjacent to a respective second portion of the first slot of the second slotted top panel, a respective third slot flap adjacent a respective first portion of the second slot of the first slotted top panel, and a respective fourth slot flap adjacent to a respective second portion of the second slot of the first slotted top panel.

16. A box including a first sliding top panel, a second sliding top panel, a first slotted top panel, and a second slotted top panel, the first sliding top panel having a terminal edge and the second sliding top panel having a second terminal edge, the first slotted top panel having a first slot and a second slot, the second slotted top panel having a third slot and a fourth slot, the first slot having an adjacent first slot tab and adjacent second slot tab, the second slot having an adjacent third slot tab and an adjacent fourth slot tab, the third slot having an adjacent fifth slot tab and an adjacent sixth slot tab, the fourth slot having an adjacent seventh slot tab and an adjacent eighth slot tab, the first slot and fourth slot receiving the second terminal edge and the second slot and third slot receiving the first terminal edge when the box is closed, the first slotted top panel further including a first cutout and the second slotted top panel including a second cutout, the first cutout located on a hinged connection to a first side panel and the second cutout located on a hinged connection to a second side panel.

* * * * *